US007896624B2

(12) United States Patent
Dass

(10) Patent No.: US 7,896,624 B2
(45) Date of Patent: Mar. 1, 2011

(54) METHOD OF RUNNING A DOWN HOLE ROTARY PUMP

(76) Inventor: Pradeep Dass, Edmonton, Alberta (CA)

( * ) Notice: Subject to any disclaimer, the term of this patent is extended or adjusted under 35 U.S.C. 154(b) by 1237 days.

(21) Appl. No.: 11/409,488

(22) Filed: Apr. 21, 2006

(65) Prior Publication Data

US 2006/0210403 A1 Sep. 21, 2006

(30) Foreign Application Priority Data

Jun. 29, 2005 (CA) ..... 2511371

(51) Int. Cl.
*F04B 39/00* (2006.01)

(52) U.S. Cl. ..... 417/414; 417/410.4; 166/348

(58) Field of Classification Search ..... 417/410.4, 417/414, 53, 423.3; 166/241.2, 68.5, 341, 166/348

See application file for complete search history.

(56) References Cited

U.S. PATENT DOCUMENTS 2,455,022 A * 11/1948 Schmidt ..... 417/99
4,421,166 A * 12/1983 Cain ..... 166/162
4,564,068 A * 1/1986 Baugh ..... 166/123
5,370,179 A * 12/1994 Mills ..... 166/68.5
5,404,946 A * 4/1995 Hess ..... 166/187
5,573,063 A 11/1996 Morrow
6,364,023 B1 * 4/2002 Hiron et al. ..... 166/373
6,413,065 B1 * 7/2002 Dass ..... 418/201.1
6,440,033 B1 8/2002 Sühling
6,598,681 B1 * 7/2003 Berry ..... 166/369
2003/0073502 A1 * 4/2003 Barnley et al. ..... 464/162

* cited by examiner

*Primary Examiner*—Devon C Kramer
*Assistant Examiner*—Leonard J Weinstein
(74) *Attorney, Agent, or Firm*—Christensen O'Connor Johnson Kindness PLLC

(57) ABSTRACT

A method of running a down hole rotary pump using a top drive, sucker rod or any drive shaft from surface. A first step involves providing a gear box having an input end and an output end. The gear box is being capable of receiving an input of a first speed at the input end and producing an output of a second speed which is one of either faster or slower than of the first speed at the output end. A second step involves positioning the gear box down hole with the input end coupled to a remote lower end of a sucker rod and the output end coupled to a rotary activated pump. A third step involves applying a driving force to the sucker rod to rotate the sucker rod at the first speed, with the rotational force being transmitted to the rotary activated pump through the gear box which rotates the rotary activated pump at the second speed.

2 Claims, 2 Drawing Sheets

METHOD OF RUNNING A DOWN HOLE ROTARY PUMP

FIELD OF THE INVENTION

The present invention relates to a method of running a down hole pump that rotates and a pump assembly in accordance with the teachings of the method.

BACKGROUND OF THE INVENTION

Down hole pumps used in the oil industry either rotate or reciprocate. Down hole pumps which rotate, such as progressive cavity pumps are connected to sucker rods which extend to a drive system positioned at surface.

SUMMARY OF THE INVENTION

According to the present invention there is provided a method of running a down hole rotary pump. A first step involves providing a gear box having an input end and an output end. The gear box is being capable of receiving an input of a first speed at the input end and producing an output of a second speed which is one of either faster or slower than of the first speed at the output end. A second step involves positioning the gear box down hole with the input end coupled to a remote lower end of a sucker rod and the output end coupled to a rotary activated pump. A third step involves applying a driving force to the sucker rod to rotate the sucker rod at the first speed, with the rotational force being transmitted to the rotary activated pump through the gear box which rotates the rotary activated pump at the second speed.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
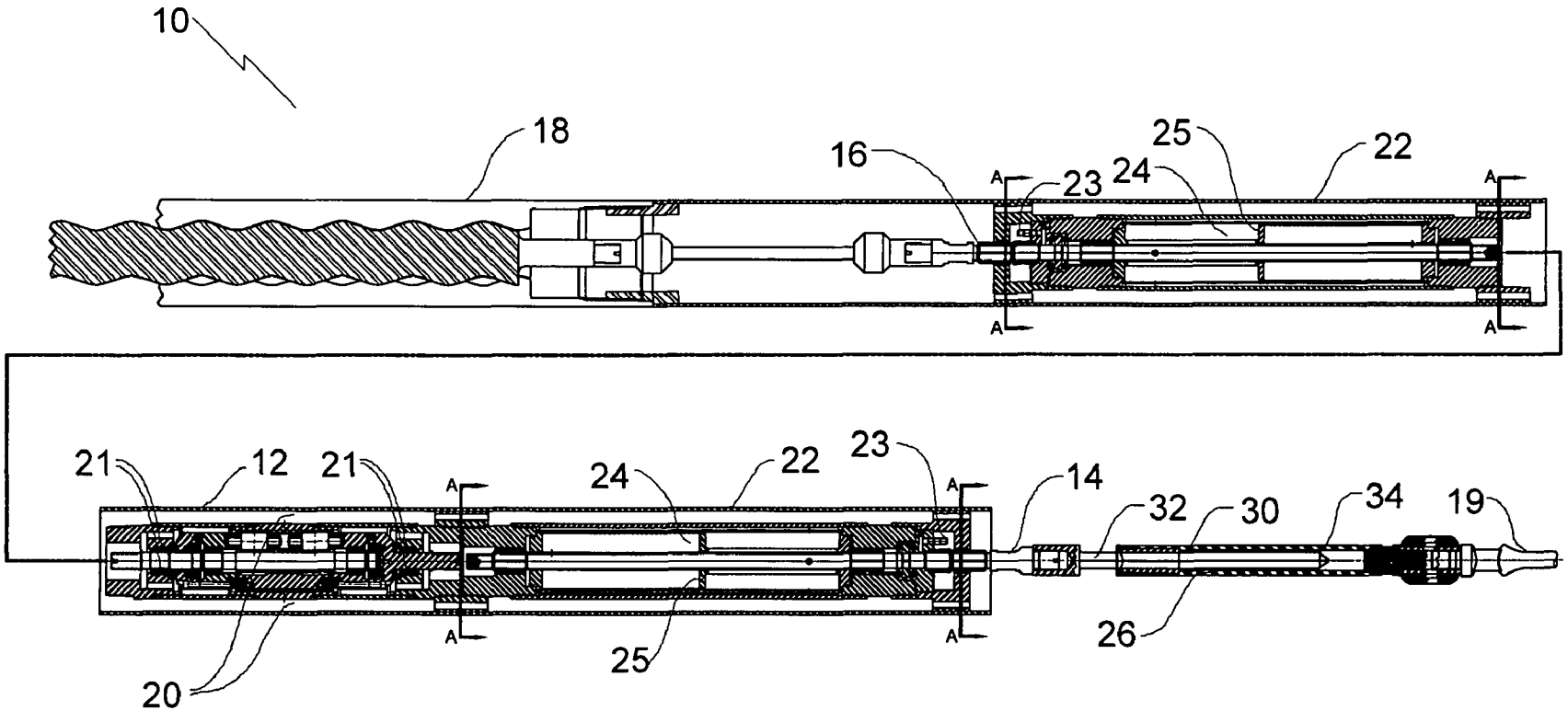
FIG. 1 is a side elevation view of a pump assembly constructed in accordance with the teachings of the present invention.

A pump assembly assembled to carry out the teachings of the preferred method, generally identified by reference numeral 10, will now be described with reference to FIGS. 1 and 2.

Figure 2:
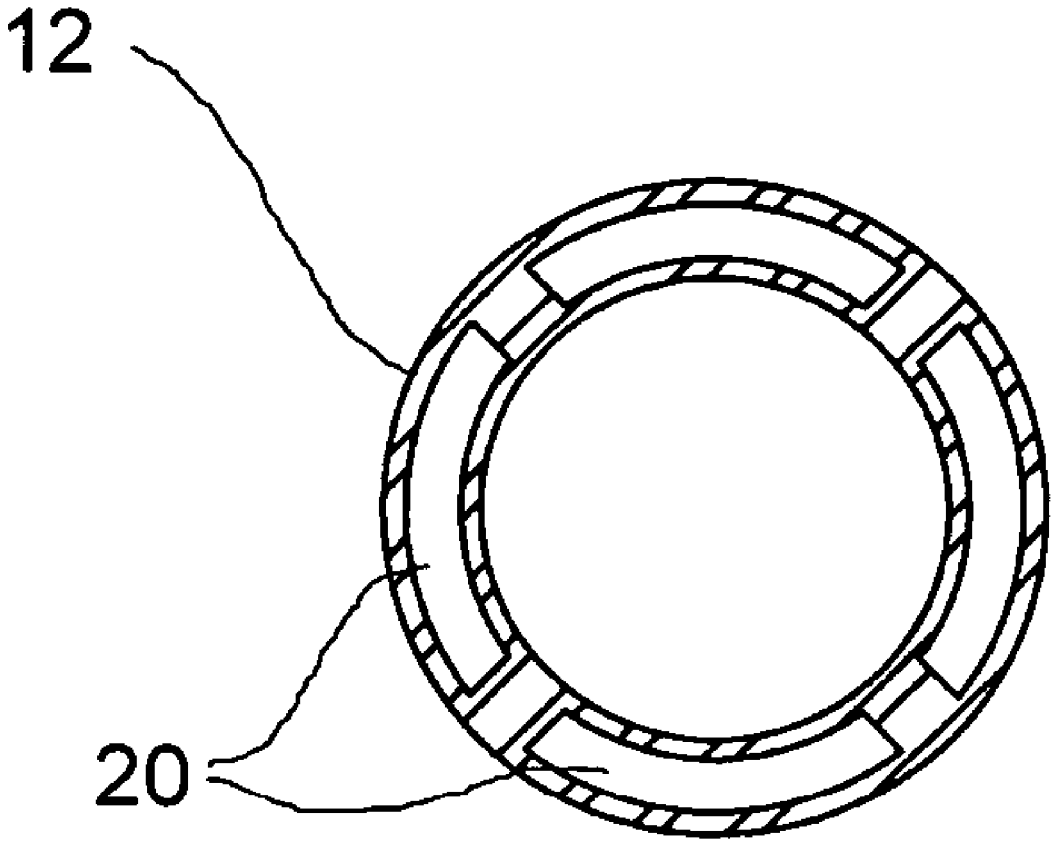
FIG. 2 is a end view, in section, taken along section lines A-A of FIG. 1.

Structure and Relationship of Parts:

Referring to FIG. 1 there is shown pump assembly 10, including a gear box 12 having an input end 14 and an output end 16. Gear box 12 is capable of receiving an input of a first speed at input end 14 and producing an output of a second speed which either faster or slower than of the first speed at output end 16, with a rotary pump 18 receiving a rotary input via output end 16 of gear box 12. For example, the second speed may be a multiple of the first speed, such that rotary pump 18 operates at higher rotations per minute than does the sucker rod 19. Referring to FIG. 2, gear box 12 has circumferential annular fluid by-pass passages 20 adapted to accommodate a flow of recovered fluids from rotary pump 18 past gear box 12 to the surface. Referring again to FIG. 1, there is also a pair of pressure compensators 22 positioned above and below gear box 12. Each pressure compensator 22 includes a lubricant filled bellows 24 adapted to move responsively to pressures and temperatures encountered during down hole operation which might otherwise adversely affect the performance of gear box 12. It will be understood that bladders or other containers could be used instead of bellows 24. Pressure compensators 22 are used to ensure that the seals 21 of gear box 12 do not overpressure and leak or blowout, since the pressure in the well bore is higher than the pressure inside of gear box 12. A check valve 23 is provided to prevent bellows 24 applying too much lubricant pressure on gear box 12. While the outside of bellows 24 is in direct contact with the well bore fluid, the inside of bellows 24 is isolated from the well bore fluid. Bellows 24 are made from two or more varying cylinders 25 so that it can move to compensate for expelled lubricant.

A coupling 26 is adapted for connecting input end 14 of gear box 12 to a sucker rod 19. It will be understood that a drive shaft may also be used in the place of sucker rod 19. Coupling 26 is a telescopic coupling 30 that has a male member 32 that slides axially within a female member 34 to accommodate limited axial movement. Male and female members 32 may have a hexagonal cross-section (as depicted), or J joints or any other positive connections may be used as coupling 26.

It will be understood that pump assembly 10 may be operated in horizontal, vertical, or slanted orientations.

Operation:

The use and operation of pump assembly 10 will now be discussed with reference to FIG. 1 and 2. Referring to FIG. 1, rotary pump 18 is connected to output end 16 of gear box 12, and sucker rod 19 is connected to input end of gear box 12 using telescoping coupling 30 by inserting male member 32 into female member 34. As sucker rod 19 is rotated, gear box converts the rotational speed to a different speed at output end 16 of gear box 12, normally a multiple of the input speed. Rotary pump 18 is thus operated. As fluid passes through by-pass passages 20, pressure is applied to bellows 24. When pressure is applied by well bore fluid, bellows 24 contracts and increases pressure on the lubricant within. This causes lubricant to flow to seals 21 of gear box 12. Check valve 23 only allows lubricant to go out and prevents fluid from the wellbore to enter. As gear box 12 is heating up and the pressure changes in the well bore, some clean lubricant will be pushed out through check valve 23 to maintain an appropriate pressure, so that seals 21 will always work only under very low differential pressures, even though the lubricant being discharged under high pressure is passing through the outside of gear box 12. Bellows 24 are made from two or more varying cylinders 25 so that it can move to compensate for expelled lubricant.

Advantages:

Pump assembly 10 uses a top driven system to run a down hole pump. It allows the pump to run faster while keeping the sucker rod or drive shaft rotating slower. This minimizes wear on tubing and increases production since the rotary pump is running faster. In some applications, there may be valid reasons to do the opposite, i.e. rotating the sucker rod faster to take advantage of optimum motor speeds and the rotary pump slower to ensure that the well bore is not pumped dry. In addition, the sucker rod or the drive shaft from surface is centralized and reducing or eliminating axial loads on the down hole pump. The teachings of this method are applicable to progressive cavity pumps, electric submersible pumps and any other type of rotary pump. Depending upon the operating environment, it may be advantageous to include one or more pressure compensator to protect the gear box from the adverse effects of pressure and elevated temperatures during operation. Although one particular configuration of pressure compensator is illustrated, one skilled in the art will appreciate that other configurations of pressure compensator may be used. Depending upon the installation, it may be advantageous to have a male to female telescoping connection that provides a positive driving connection, while accommodating limited axial movement.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

What is claimed is:

1. A pump assembly, comprising:

a gear box having an input end and an output end, the gear box being capable of receiving an input of a first speed at the input end and producing an output of a second speed which is one of either faster or slower than the first speed at the output end;

a progressive cavity rotary pump receiving rotary input via the output end of the gear box;

the gear box having circumferential annular fluid by-pass passages that accommodate a flow of recovered fluids from the progressive cavity rotary pump past the gear box to surface;

a pair of pressure compensators positioned above and below the gear box, each of the pressure compensators including a lubricant filled bellows that moves responsively to pressures and temperatures encountered during down hole operation which might otherwise adversely affect the performance of the gear box; and a coupling that connects the input end of the gear box to a sucker rod, the coupling being a telescopic coupling having a male member which slides axially within a female member to accommodate limited axial movement.

2. The pump assembly as defined in claim 1, wherein the second speed is a multiple of the first speed, such that the progressive cavity rotary pump operates at higher rotations per minute than does the sucker rod.

* * * * *